US011308905B2

(12) United States Patent
Yagi et al.

(10) Patent No.: US 11,308,905 B2
(45) Date of Patent: Apr. 19, 2022

(54) LIQUID CRYSTAL DISPLAY DEVICE, VOLTAGE SETTING METHOD FOR LIQUID CRYSTAL DISPLAY DEVICE AND METHOD FOR PRODUCING LIQUID CRYSTAL DISPLAY DEVICE

(71) Applicant: SHARP KABUSHIKI KAISHA, Sakai (JP)

(72) Inventors: Yoshimasa Yagi, Sakai (JP); Masatoshi Itoh, Sakai (JP); Shogo Nishiwaki, Sakai (JP); Hisashi Nagata, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/151,431

(22) Filed: Jan. 18, 2021

(65) Prior Publication Data

US 2021/0248970 A1 Aug. 12, 2021

Related U.S. Application Data

(60) Provisional application No. 62/971,755, filed on Feb. 7, 2020.

(51) Int. Cl.
*G09G 3/36* (2006.01)

(52) U.S. Cl.
CPC ..... *G09G 3/3648* (2013.01); *G09G 3/3696* (2013.01); *G09G 2300/0426* (2013.01); *G09G 2320/046* (2013.01)

(58) Field of Classification Search
CPC ..... G09G 3/3648; G09G 3/3696; G09G 2300/0426; G09G 2320/046
USPC ..... 345/214
See application file for complete search history.

(56) References Cited

U.S. PATENT DOCUMENTS

2002/0041354 A1 4/2002 Noh et al.
2018/0233100 A1* 8/2018 Shin ..... G09G 3/3648
2019/0333458 A1* 10/2019 Chen ..... G09G 3/3688
2021/0225318 A1* 7/2021 Guo ..... G09G 3/3696

FOREIGN PATENT DOCUMENTS

JP 2002182230 A 6/2002

* cited by examiner

*Primary Examiner* — Kent W Chang
*Assistant Examiner* — Sujit Shah
(74) *Attorney, Agent, or Firm* — ScienBiziP, P.C.

(57) ABSTRACT

A liquid crystal display device includes a liquid crystal display panel including a plurality of pixels, and a control circuit configured to generate a source signal voltage supplied to each pixel. The liquid crystal display panel includes an active matrix substrate including a pixel electrode applied with a source signal voltage and a common electrode applied with a common voltage. The common voltage and the source signal voltage corresponding to each gradation are set such that a source-common center difference at least one of lowest and highest gradation levels is greater than the source-common center difference at least some of the other gradation levels. A degree of symmetry of a gradation level voltage is equal to or lower than 95% at least at one of gradation levels equal to or lower than a 127/255-th gradation level except for the lowest gradation level.

17 Claims, 13 Drawing Sheets

LIQUID CRYSTAL DISPLAY DEVICE, VOLTAGE SETTING METHOD FOR LIQUID CRYSTAL DISPLAY DEVICE AND METHOD FOR PRODUCING LIQUID CRYSTAL DISPLAY DEVICE

TECHNICAL FIELD

The present invention relates to a liquid crystal display device. The present invention also relates to a method of setting a voltage of a liquid crystal display device and a method of producing a liquid crystal display device.

DESCRIPTION OF THE RELATED ART

In recent years, a fringe field switching (FFS) mode has been used as a display mode of a medium or small-sized liquid crystal display device used in a tablet device, a notebook PC, or a smartphone. The FFS mode is one of in-plane electric field modes in which displaying is performed using an in-plane electric field. An FFS mode liquid crystal display device is disclosed in, for example, Japanese Unexamined Patent Application Publication No. 2002-182230.

In the FFS-mode liquid crystal display device, a pair of electrodes for generating an in-plane electric field is formed on one of substrates which are paired and between which a horizontally oriented liquid crystal layer is disposed. The pair of electrodes includes, for example, a pixel electrode with a plurality of slits and a common electrode disposed under the pixel electrode via an insulating layer. Alternatively, the pair of electrodes includes a common electrode with a plurality of slits and a pixel electrode disposed under the common electrode via an insulating layer. A display signal voltage (a source signal voltage) is applied to the pixel electrode, while a common voltage is applied to the common electrode. When voltages are respectively applied to the pixel electrode and the common electrode, an in-plane electric field is generated, and the alignment orientation of the liquid crystal molecules is changed by an alignment control force of this in-plane electric field.

Thus, in the FFS-mode liquid crystal display device, the orientation state of the liquid crystal molecules is controlled by using the in-plane electric field. In the FFS mode, liquid crystal molecules rotate in a plane parallel to a display surface, which makes it possible to achieve a high viewing angle characteristic. The in-plane electric field generated by the electrode structure in the FFS mode is also called a "fringe electric field".

SUMMARY

In liquid crystal display devices, if a same image is continuously displayed for a long period of time, an after-image phenomenon called image retention occurs. This is because an application of a voltage for a long period of time causes a charge (called a "DC charge") to be accumulated in pixel capacitance. The amount of charge accumulated in the pixel capacitance varies depending on the gradation level displayed, and the higher the gradation level, the more charge is accumulated.

As a result, a difference in the amount of accumulated charge (the amount of DC charge) among the gradation levels displayed is visible as a difference in luminance. In in-plane electric field modes such as the FFS mode, pixel electrodes and a common electrode are formed on a same substrate, and thus a stronger electric field occurs near the electrodes than in vertical electric field modes. This causes a charge to be easily accumulated, which results in an increase in probability of occurrence of image retention.

Furthermore, when a liquid crystal display device displays the highest gradation level for a long period of time (especially in a high temperature environment), the positive-negative symmetry of the applied voltage is disturbed by a pull-in phenomenon caused by capacitance of a TFT and/or a liquid crystal, which causes a charge to easily remain. This residual charge can cause unevenness or staining to occur in reliability tests, or cause flicker to become noticeable, which results in a reduction in display quality.

In view of the above problems, an object of the present invention is to, in a liquid crystal display device in an in-plane electric field mode, effectively suppress an occurrence of image retention and/or degradation of display quality caused by a residual charge.

The present description discloses a liquid crystal display device, a voltage setting method for a liquid crystal display device, and a method for producing a liquid crystal display device as described below in the following items.

[Item 1]

A liquid crystal display device including a liquid crystal display panel including a plurality of pixels, the liquid crystal display panel including an active matrix substrate, a counter substrate opposing the active matrix substrate, and a liquid crystal layer disposed between the active matrix substrate and the counter substrate, and a control circuit configured to generate source signal voltages supplied to respective pixels of the plurality of pixels in response to receiving input display signals indicating gradation levels to be displayed by the respective pixels of the plurality of pixels, the active matrix substrate including pixel electrodes which are provided in the respective pixels of the plurality of pixels and to which the source signal voltages are applied, and a common electrode to which a common voltage is applied to generate, together with the pixel electrodes, in-plane electric fields, wherein when a source-common center difference is defined by a difference between a center level of each source signal voltage and a center level of the common voltage, the common voltage and the source signal voltage corresponding to each gradation level are set such that the source-common center difference at least at one of a lowest gradation level and a highest gradation level is greater than the source-common center difference at least at part of the other gradation levels, and wherein when Vp denotes an absolute value of a positive polarity potential of each source signal voltage and Vn denotes an absolute value of a negative polarity potential of each source signal voltage, and a degree of symmetry of a gradation level voltage at each gradation level is defined such that when a relationship $Vp>Vn$ is satisfied for Vp and Vn of the source signal voltage at a 127/255-th gradation level, the degree of symmetry is given by $(Vn/Vp)\cdot 100[\%]$ while when a relationship $Vp<Vn$ is satisfied for Vp and Vn of the source signal voltage at the 127/255-th gradation level, the degree of symmetry is given by $(Vp/Vn)\cdot 100[\%]$, the degree of symmetry of the gradation level voltage is equal to or smaller than 95% at least at one of gradation levels equal to or lower than the 127/255-th gradation level.

[Item 2]

The liquid crystal display device according to Item 1, wherein the source-common center difference at least at one of the lowest and highest gradation levels is two or more times as great as the source-common center difference at the other one of the lowest and highest gradation levels.

[Item 3]

The liquid crystal display device according to Item 1 or 2, wherein the common voltage and the source signal voltage corresponding to each gradation level are set such that the source-common center difference at the lowest gradation level is greater than the source-common center difference at least at part of the other gradation levels.

[Item 4]

The liquid crystal display device according to Item 3, wherein the degree of symmetry of the gradation level voltage at the lowest gradation level is equal to or greater than 90%.

[Item 5]

The liquid crystal display device according to Item 1 or 2, wherein the common voltage and the source signal voltage corresponding to each gradation level are set such that the source-common center difference at the highest gradation level is greater than the source-common center difference at least at part of the other gradation levels.

[Item 6]

The liquid crystal display device according to Item 5, wherein the degree of symmetry of the gradation level voltage at the highest gradation level is equal to or greater than 97%.

[Item 7]

The liquid crystal display device according to Item 1 or 2, wherein the common voltage and the source signal voltage corresponding to each gradation level are set such that the source-common center difference at the lowest gradation level and the source-common center difference at the highest gradation level are greater than the source-common center difference at least at part of the other gradation levels.

[Item 8]

The liquid crystal display device according to Item 7, wherein the degree of symmetry of the gradation level voltage at the lowest gradation level is equal to or higher than 90% and the degree of symmetry of the gradation level voltage at the highest gradation level is equal to or higher than 97%.

[Item 9]

The liquid crystal display device according to one of Items 1 to 8, wherein the common voltage and the source signal voltage corresponding to each gradation level are set such that the source-common center difference at least at one of the lowest gradation level and the highest gradation level is greater than the source-common center difference at any one of the other gradation levels.

[Item 10]

The liquid crystal display device according to one of Items 1 to 4, wherein the common voltage and source signal voltage corresponding to each gradation level are set such that the source-common center difference at the lowest gradation level is greater than the source-common center difference at any one of the other gradation levels.

[Item 11]

The liquid crystal display device according to Item 1, 2, 5, or 6, wherein the common voltage and source signal voltage corresponding to each gradation level are set such that the source-common center difference at the highest gradation level is greater than the source-common center difference at any one of other gradation levels.

[Item 12]

The liquid crystal display device according to Item 1, 2, 7, or 8, wherein the common voltage and the source signal voltages corresponding to each gradation level are set such that the source-common center differences at the lowest gradation level and the highest gradation level are greater than the source-common center difference at any one of the other gradation levels.

[Item 13]

A voltage setting method for setting the common voltage and the source signal voltage corresponding to each gradation level of the liquid crystal display device according to one of Items 1 to 12, the method comprising (A) setting a tentative common voltage and a tentative source signal voltage corresponding to each gradation level, (B) offsetting the tentative common voltage in one direction of the positive and negative directions, and (C) offsetting the tentative source signal voltage in the one direction at least at part of the gradation levels except for at least one of the lowest and highest gradation levels.

[Item 14]

The voltage setting method according to Item 13, wherein, in (C), the tentative source signal voltages are offset for all gradation levels other than the lowest gradation level.

[Item 15]

The voltage setting method according to Item 13, wherein, in (C), the tentative source signal voltages are offset for all gradation levels other than the highest gradation level.

[Item 16]

The voltage setting method according to Item 13, wherein, in (C), the tentative source signal voltages are offset for all gradation levels other than the lowest and highest gradation levels.

[Item 17]

A method of producing a liquid crystal display device, comprising setting the common voltage and the source signal voltage corresponding to each gradation level by using the voltage setting method according to one of Items 13 to 16.

Advantageous Effects of Invention

According to an embodiment of the present invention, in a liquid crystal display device in an in-plane electric field mode, an occurrence of image retention and/or degradation of display quality caused by a residual charge can be effectively suppressed.

DESCRIPTION OF EMBODIMENTS

Embodiments of the present invention are described below with reference to drawings. Note that the present invention is not limited to the embodiments described below.

[Notations of Gradation Levels in the Present Description]

In displaying in 256 gradation levels (8 bits), a "0th gradation level" is a lowest gradation level corresponding to black and a "255th gradation level" is a highest gradation level corresponding to white. In displaying in 1024 gradation levels (10 bits), a "0th gradation level" is a lowest gradation level and a "1023rd gradation level" is a highest gradation level. In the present description, unless otherwise specified, gradation levels are expressed based on a case where gradation levels displayed in 256 gradation levels, and a gradation level corresponding to an N-th gradation level in the 256 gradation levels is denoted as an "N/255-th gradation level". "Displaying of, for example, a 127/255-th gradation level" does not necessarily mean that displaying is performed in a 256 gradation level system. The 127/255-th gradation level may be not only the 127-th gradation level in the 256 gradation level system, but may be any equivalent gradation level in other gradation level systems such as a 508-th gradation level in a 1024 gradation level system.

Embodiment 1

The inventor of the present application has investigated a technique of offsetting a source signal voltage corresponding to a lowest gradation level thereby reducing image retention. By offsetting the source signal voltage at the lowest gradation level, the amount of charge accumulated in pixel capacitance during displaying of the gradation level can be made closer to the amount of charge accumulated in pixel capacitance during displaying of other gradation levels, which results in a reduction in the image retention.

In a case where there is no restriction on a voltage input to a source driver IC (a driver IC), any offset can be provided without changing a source signal voltage at the lowest gradation level (that is, while maintaining the same amplitude). However, in a case where there is a restriction on the voltage input to the source driver IC, (for example, in a case where the source signal voltage at the lowest gradation level is defined by an upper limit and a lower limit of an allowed input range), to provide an offset, it is necessary to change the source signal voltage at the lowest gradation level (that is, it is necessary to increase the amplitude). As a result, an increase occurs in luminance in displaying the lowest gradation level, that is, a black level, and thus there is a possibility that an adverse effect on an optical characteristic may occur. Regarding this, a further specific explanation is given below.

Figure 12:
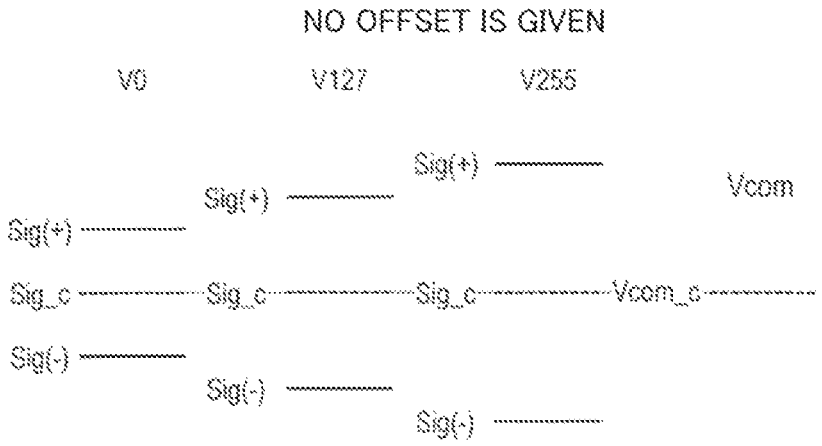
FIG. 12 is a diagram illustrating examples of source signal voltages and a common voltage for a case where no offset is applied to the source signal voltages.

FIG. 12 shows examples of source signal voltages and a common voltage for a case where no offset is provided. In FIG. 12, the source signal voltages shown include a source signal voltage V0 at a lowest gradation level (a 0/255-th gradation level), a source signal voltage V127 at a 127/255-th gradation level, and a source signal voltage V255 at a highest gradation level (a 255/255-th gradation level). For each source signal voltage, a positive polarity potential Sig(+), a negative polarity potential Sig(−), and a center level Sig_c are shown. For the common voltage (Vcom), a center level Vcom_c is shown.

For ease of understanding, FIG. 12 shows a case where the center level Sig_c is equal for all source signal voltages and equal to the center level Vcom_c of the common voltage. In the following description, the center level Sig_c defined to be equal for all the source signal voltages of the respective gradation levels is also referred to as a "standard source center level". As shown in FIG. 12, the higher the gradation level, the greater the difference between the positive polarity potential Sig(+) and the negative polarity potential Sig(−) of the source signal voltage, that is, the greater the amplitude of the source signal voltage. Therefore, the amount of charge accumulated in a pixel which displays the lowest gradation level is smaller than the amount of charge accumulated in pixels displaying other gradation levels, which may cause image retention to occur easily. In a case where the positive polarity potential Sig(+) and the negative polarity potential Sig(−) of the source signal voltage V0 at the lowest gradation level are respectively set at the upper limit and the lower limit of the allowed input range of the driver IC, it is not allowed to give an offset to the source signal voltage V0 while maintaining the same amplitude.

Figure 13:
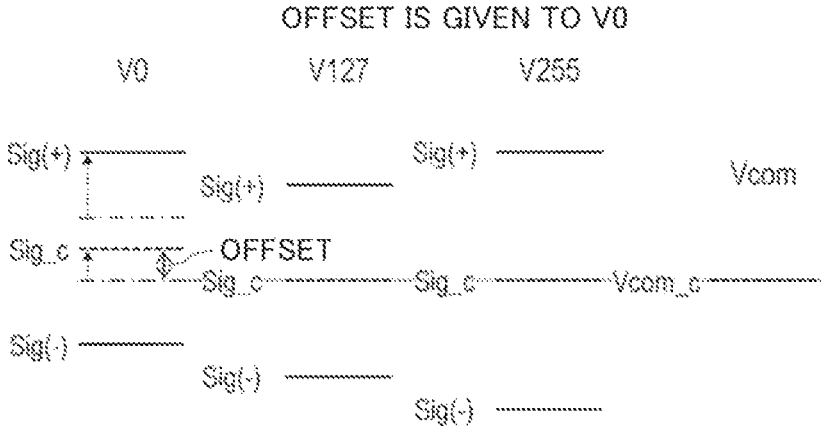
FIG. 13 is a diagram illustrating examples of source signal voltages and a common voltage for a case where offsetting is provided by increasing an amplitude of a source signal voltage V0 at a lowest gradation level.

FIG. 13 shows an example of providing an offset to the source signal voltage V0 by changing the amplitude. In the example shown in FIG. 13, the offset is provided by increasing the amplitude of the source signal voltage V0 of the lowest gradation level. In this example, the amplitude of the source signal voltage V0 of the lowest gradation level is increased while maintaining the negative polarity potential Sig(−), and thus the positive polarity potential Sig(+) and the center level Sig_c are shifted to higher values. Therefore, the center level Sig_c of the source signal voltage V0 of the lowest gradation level is different from the center level Vcom_c of the common voltage Vcom and the center level Sig_c of the source signal voltages of the other gradation levels (that is, the standard source center level). According to the example shown in FIG. 13, the amount of charge accumulated in a pixel which displays the lowest gradation level can be made closer to the amounts of charge accumulated in pixels which display the other gradation levels, which can result in a reduction in image retention. However, an increase in the source signal voltage V0 at the lowest gradation level occurs. As a result, an increase in luminance in displaying black occurs, and thus there is a possibility that an adverse effect such as a reduction in the contrast ratio on an optical characteristic may occur.

Figure 1:
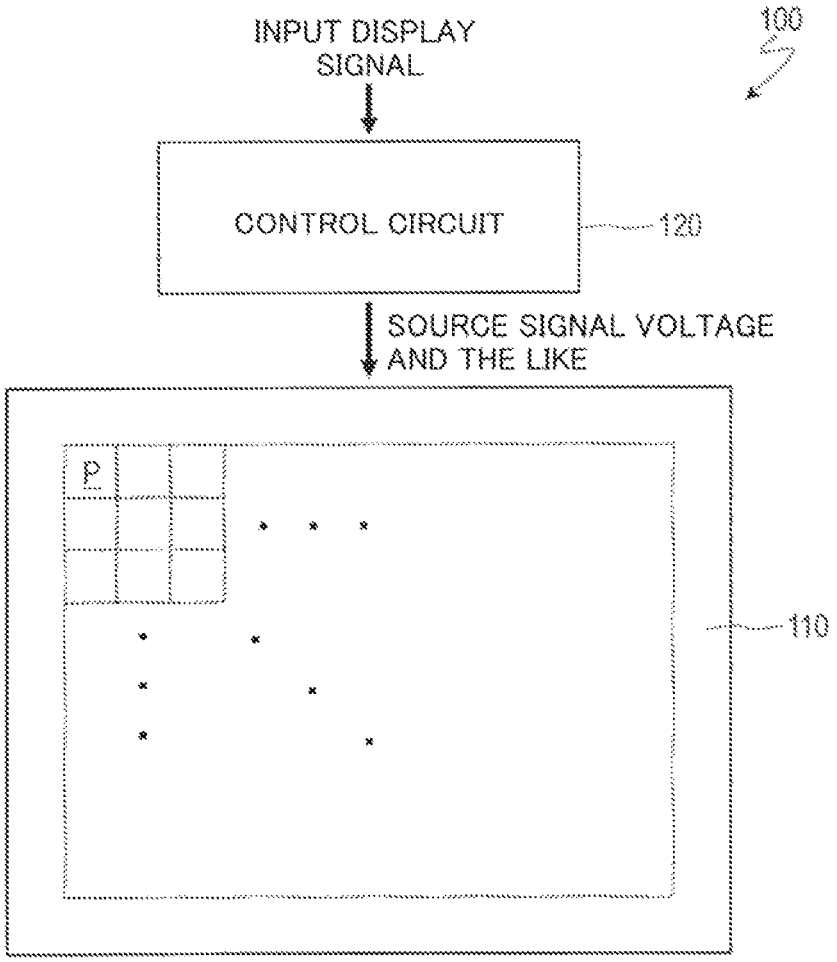
FIG. 1 is a block diagram schematically illustrating a liquid crystal display device 100 according to an embodiment of the present invention.

A liquid crystal display device according to the present embodiment is described below. FIG. 1 is a block diagram schematically illustrating a liquid crystal display device 100 according to the present embodiment.

As shown in FIG. 1, the liquid crystal display device 100 includes a liquid crystal display panel 110 and a control circuit 120.

The liquid crystal display panel 110 includes a plurality of pixels P. The plurality of pixels P are arranged in a matrix including a plurality of rows and a plurality of columns.

The control circuit 120 is configured to generate various signal voltages for driving the liquid crystal display panel 110. For example, in response to receiving an input display signal indicating gradation levels displayed by the plurality of pixels P, the control circuit 120 generates source signal voltages to be supplied to the respective pixels P.

Figure 2:
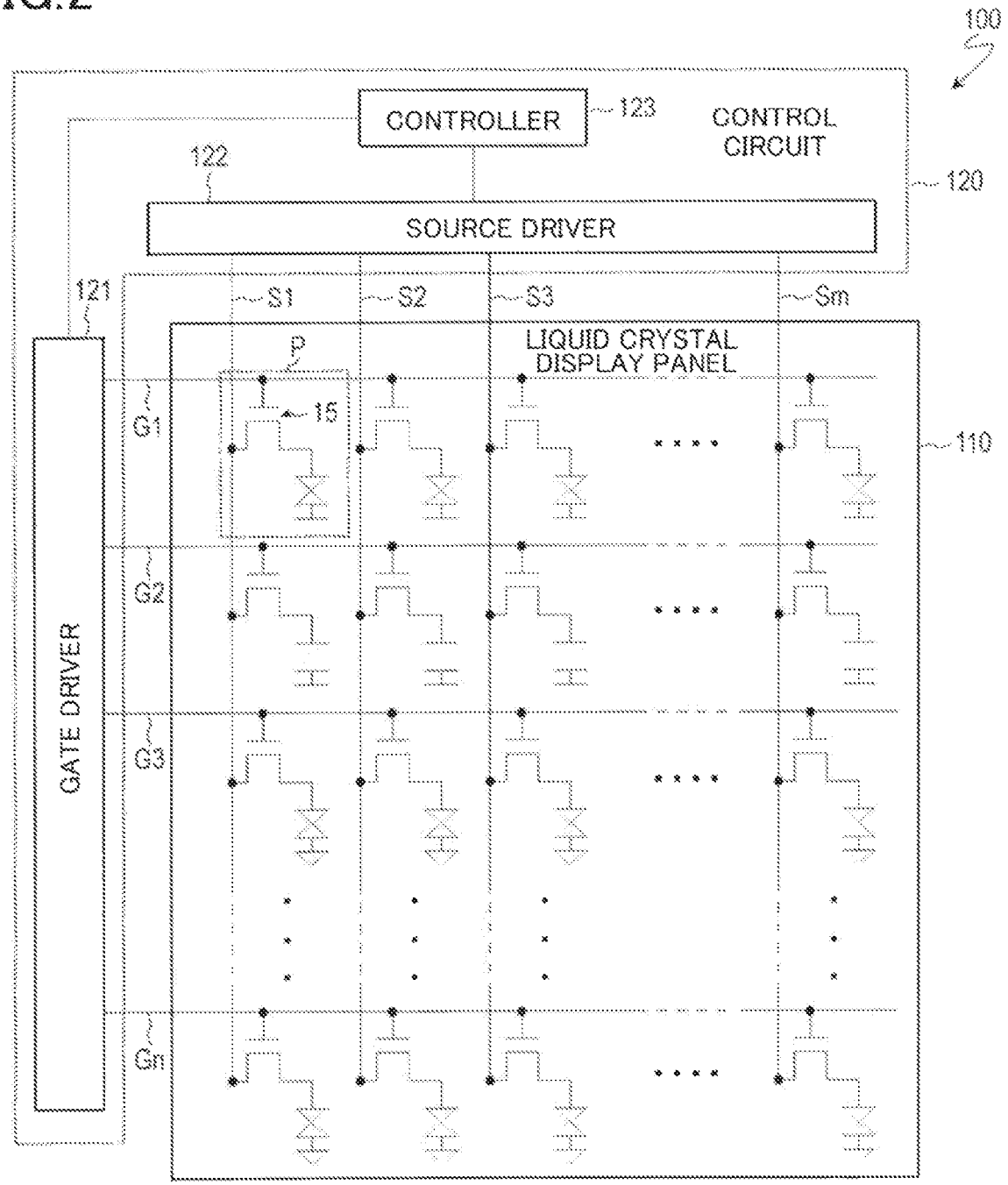
FIG. 2 is a block diagram schematically illustrating the liquid crystal display device 100.
Figure 3:
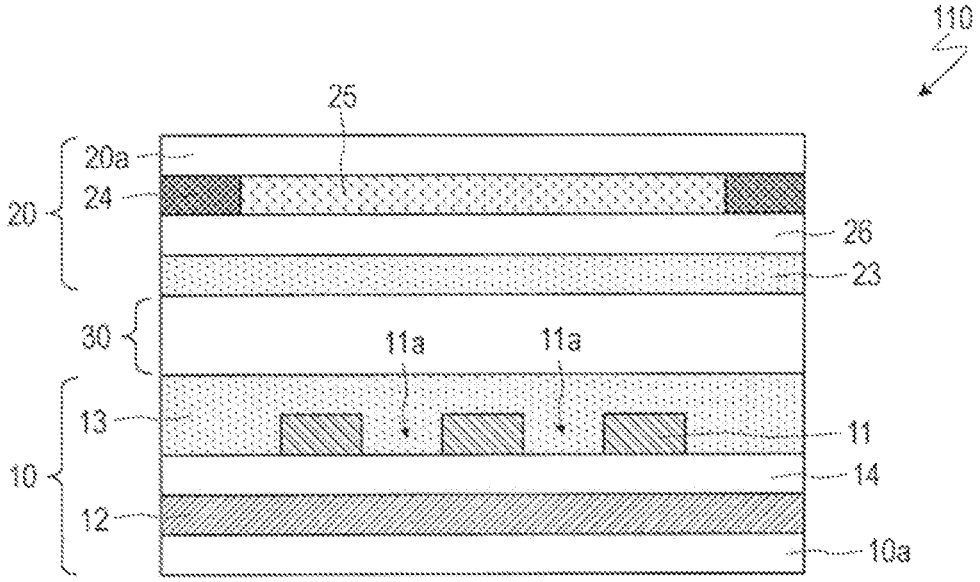
FIG. 3 is a cross-sectional view schematically illustrating a liquid crystal display panel 110 included in the liquid crystal display device 100.

Referring also to FIG. 2 and FIG. 3, the configuration of the liquid crystal display device 100 is described in further detail below. FIG. 2 illustrates the details of the configuration of the liquid crystal display device 100. FIG. 3 is a cross-sectional view schematically illustrating the liquid crystal display panel 110 of the liquid crystal display device 100. The liquid crystal display panel 110 shown in FIG. 3 is configured to operate in, by way of example, the FFS mode.

The liquid crystal display panel 110 includes, as shown in FIG. 3, an active matrix substrate 10, a counter substrate 20 opposing the active matrix substrate 10, and a liquid crystal layer 30 provided between the active matrix substrate 10 and the counter substrate 20.

The active matrix substrate (also referred to as a "TFT substrate") 10 includes a transparent substrate 10*a*, a first electrode 11, a second electrode 12, and an alignment film 13.

The transparent substrate 10*a* is, for example, a glass substrate or a plastic substrate. The first electrode 11, the second electrode 12 and the alignment film 13 are formed on the transparent substrate 10*a* so as to be located on the side of the liquid crystal layer 30, and they are supported by the transparent substrate 10*a*.

The alignment film 13 is provided in contact with the liquid crystal layer 30. That is, the alignment film 13 is located on the top surface of the active matrix substrate 10 on the side of the liquid crystal layer 30. The alignment film 13 defines the initial alignment orientation of liquid crystal molecules. The initial alignment orientation is an orientation of the liquid crystal molecules in a state in which no electric field is applied to the liquid crystal layer 30.

The first electrode 11 and the second electrode 12 generate an in-plane electric field (a fringe electric field) that causes the liquid crystal molecules to be aligned in an orientation different from the initial alignment orientation. The first electrode 11 and the second electrode 12 are each formed of a transparent conductive material (for example, ITO or IZO).

The first electrode 11 is a pixel electrode formed in each of the plurality of pixels P. In contrast, the second electrode 12 is a common electrode formed in common for the plurality of pixels P. The pixel electrode 11 is formed on the common electrode 12 via the insulating layer 14. The insulating layer 14 is, for example, a silicon nitride (SiNx) layer, a silicon oxide ($SiO_2$) layer, or a silicon nitride (SiNxOy) layer. Alternatively, the insulating layer 14 may have a multilayer structure including two layers of the above-described layers.

The pixel electrode 11 has at least one slit (two slits in the present example) 11*a*. The direction of the in-plane electric field generated by the pixel electrode 11 and the common electrode 12 is orthogonal to the direction in which the slit 11*a* extends.

As shown in FIG. 2, the liquid crystal display panel 110 includes a plurality of scanning lines (gate bus lines) G1 to Gn extending in a row direction (hereinafter simply referred to as "scanning lines G"), a plurality of signal lines (source bus lines) S1 to Sm extending in a column direction (hereinafter simply referred to as "signal lines S"), and thin-film transistors (TFTs) 15 provided for the respective pixels P. The scanning lines G, the signal lines S, and the TFTs 15 are formed on the active matrix substrate 10.

The scanning lines G apply scanning signals (gate signal voltages) to the TFTs 15. The signal lines S apply display signals (source signal voltages) to the TFTs 15. A gate electrode, a source electrode, and a drain electrode of each TFT 15 are electrically connected to a scanning line G, a signal line G, and a pixel electrode 11, respectively.

The source signal voltage is applied to the pixel electrode 11 via the TFT 15. A voltage common for all pixels P (a common voltage) is applied to the common electrode 12. The common voltage is set to an optimum value (referred to as "optimum Vcom") that is optimum to reduce flicker.

The counter substrate (also referred to as a "color filter substrate") 20 includes a transparent substrate 20*a* and an alignment film 23, as shown in FIG. 3.

The transparent substrate 20*a* is, for example, a glass substrate or a plastic substrate. The alignment film 23 is provided on the transparent substrate 20*a* so as to be located on the side of the liquid crystal layer 30, and is supported by the transparent substrate 20*a*.

The alignment film 23 is provided in contact with the liquid crystal layer 30. That is, the alignment film 23 is located on the top surface of the counter substrate 20 on the side of the liquid crystal layer 30. The alignment film 23 defines the initial alignment orientation of the liquid crystal molecules as with the alignment film 13 of the active matrix substrate 10. The alignment orientation of the liquid crystal molecules defined by the alignment film 23 is parallel or anti-parallel to the alignment orientation of the liquid crystal molecules defined by the alignment film 13.

In the example illustrated in the figure, the counter substrate 20 further includes a light shielding layer (a black matrix) 24, a color filter layer 25 and an overcoat layer 26.

The light shielding layer 24 and the color filter layer 25 are provided on the transparent substrate 20*a* on the side of the liquid crystal layer 30. The color filter layer 25 includes, for example, red color filters, green color filters and blue color filters.

The overcoat layer 26 covers the light shielding layer 24 and the color filter layer 25. The overcoat layer 26 is formed of, for example, a transparent resin material. The alignment film 23 is provided on the overcoat layer 26.

The liquid crystal layer 30 is formed of a positive- or negative-type liquid crystal material. In a case where the liquid crystal layer 30 is formed of the positive-type liquid crystal material (that is, in a case where the liquid crystal molecules have a positive dielectric anisotropy), the alignment control force by the in-plane electric field causes the alignment orientation of the liquid crystal molecules to change so as to approach an orientation parallel to the direction of the in-plane electric field. In a case where the liquid crystal layer 30 is formed of the negative-type liquid crystal material (that is, in a case where the liquid crystal molecules have a negative dielectric anisotropy), the alignment control force by the in-plane electric field causes the alignment orientation of the liquid crystal molecules to change so as to approach an orientation perpendicular to the direction of the transverse electric field.

The alignment films 13 and 23 disposed on respective both sides of the liquid crystal layer 30 are horizontal alignment films.

Thus, the liquid crystal molecules are aligned nearly parallel to the surfaces of the active matrix substrate 10 and the counter substrate 20.

Although not shown in the figure, the liquid crystal display device 100 further includes at least a pair of polarizers facing each other through the liquid crystal layer 30. The pair of polarizers is disposed in a cross-Nicol manner. The transmission axis of one of the pair of polarizers is approximately parallel to the initial alignment orientation of the liquid crystal molecules, and the transmission axis of the other one is approximately orthogonal to the initial alignment orientation.

The control circuit 120 includes a gate driver (a scanning line drive circuit) 121, a source driver (a signal line drive circuit) 122, and a controller 123.

The gate driver 121 supplies a gate signal voltage to the scanning line G. The source driver 122 supplies a source signal voltage to the signal line S. The controller 123 generates various timing pulses necessary to drive the active matrix substrate 100 and controls the gate driver 121 and the source driver 122.

Figure 4:
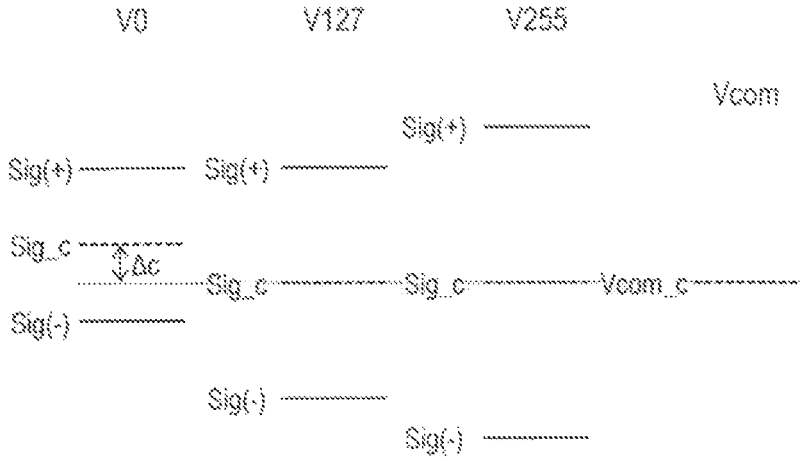
FIG. 4 is a diagram illustrating an example of setting source signal voltages and a common voltage in the liquid crystal display device 100.

Next, referring to FIG. 4, the setting of the source signal voltages and the common voltage in the liquid crystal display device 100 according to the present embodiment is described.

FIG. 4 shows an example of setting the source signal voltages and the common voltage in the liquid crystal display device 100. In FIG. 4, the source signal voltages shown include a source signal voltage V0 at a lowest gradation level (a 0/255-th gradation level), a source signal voltage V127 at a 127/255-th gradation level, and a source signal voltage V255 at a highest gradation level (a 255/255-th gradation level). For each source signal voltage, a positive polarity potential Sig(+), a negative polarity potential Sig (−), and a center level Sig_c are shown. For the common voltage, a center level Vcom_c is shown Note that a difference may occur between the center level Sig_c of each source signal voltage and the center level Vcom_c of the common voltage (which is hereafter referred to as the "source-common center difference" or simply as "Δc").

In the present embodiment, the common voltage and the source signal voltage corresponding to each gradation level are set such that the source-common center difference at the lowest gradation level is greater than the source-common center difference at least at part of the other gradation levels. More specifically, the common voltage and the source signal voltage corresponding to each gradation level are set such that Δc at the lowest gradation level is greater than Δc at any other gradation levels. Although for simplicity of explanation, FIG. 4 illustrates a case where Δc is zero at gradation levels other than the lowest gradation level, Δc may take a value other than zero at gradation levels other than the lowest gradation level.

Next, a discussion is given below as to the symmetry of the source signal voltage at each gradation level (a relationship between the absolute value Vp of the positive polarity potential and the absolute value Vn of the negative polarity potential). In the present description, the degree of symmetry of a gradation level voltage at each gradation level is defined such that when a relationship Vp>Vn is satisfied for Vp and Vn of the source signal voltage at a 127/255-th gradation level, the degree of symmetry is given by (Vn/Vp)·100 [%] while when a relationship Vp<Vn is satisfied for Vp and Vn of the source signal voltage at the 127/255-th gradation level, the degree of symmetry is given by (Vp/Vn)·100 [%], In the present embodiment, as will be described in further detail later, the degree of symmetry of the gradation level voltage is equal to or lower than 95% at least one of gradation levels equal to or lower than 127/255-th gradation level (that is, at least one of gradation levels from the 1/255-th to 127/255-th gradation levels).

The common voltage and the source signal voltages in the liquid crystal display device 100 may be set, for example, as follows.

Figure 5A:
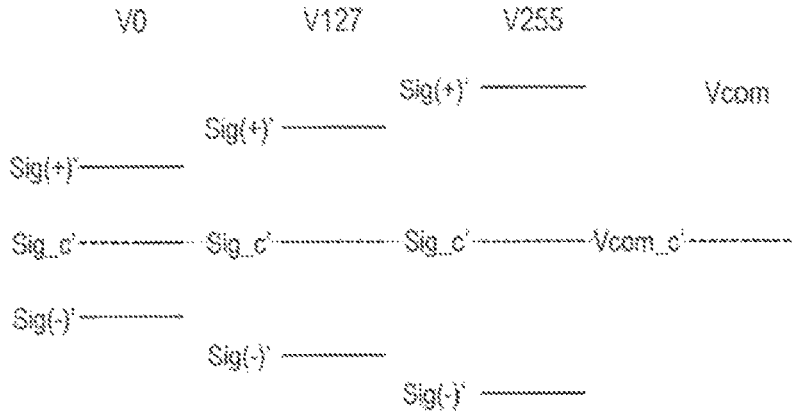
FIG. 5A is a diagram illustrating a method of setting source signal voltages and a common voltage in the liquid crystal display device 100.

First, as shown in FIG. 5A, a tentative common voltage and a tentative source signal voltage corresponding to each gradation level are set. In FIG. 5A, a positive polarity potential Sig(+)', a negative polarity potential Sig(−)', and a center level Sig_c' are shown for each of the tentative source signal voltages of the lowest gradation level (the 0/255-th gradation level), the 127/255-th gradation level, and the highest gradation level (the 255/255-th gradation level). Furthermore, a center level Vcom_c' is shown for the tentative common voltage. In this example, the center level Sig_c' is equal for all tentative source signal voltages at the respective gradation levels (an uncorrected standard source center level), and the center level Vcom_c' of the tentative common voltage is equal to this uncorrected standard source center level.

Figure 5B:
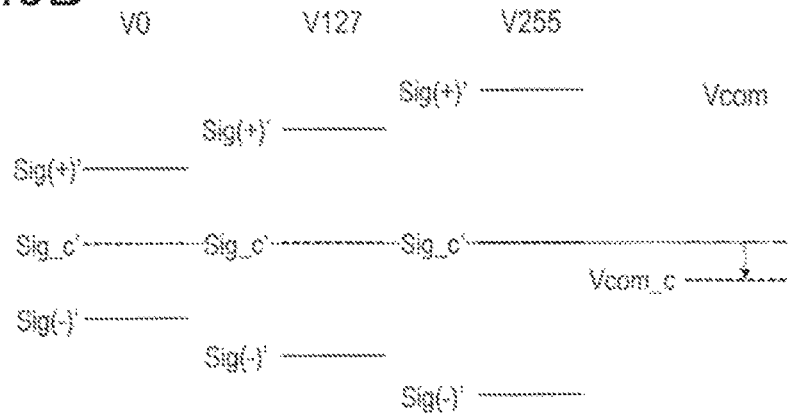
FIG. 5B is a diagram illustrating a method of setting source signal voltages and a common voltage in the liquid crystal display device 100.

Next, the tentative common voltage is offset in one of the positive and negative directions, as shown in FIG. 5B. In this example, the tentative common voltage is offset in the negative direction, and a result is employed as a final common voltage. The center level Vcom_c of the common voltage after being offset is lower than the center level Vcom_c' of the tentative common voltage.

Figure 5C:
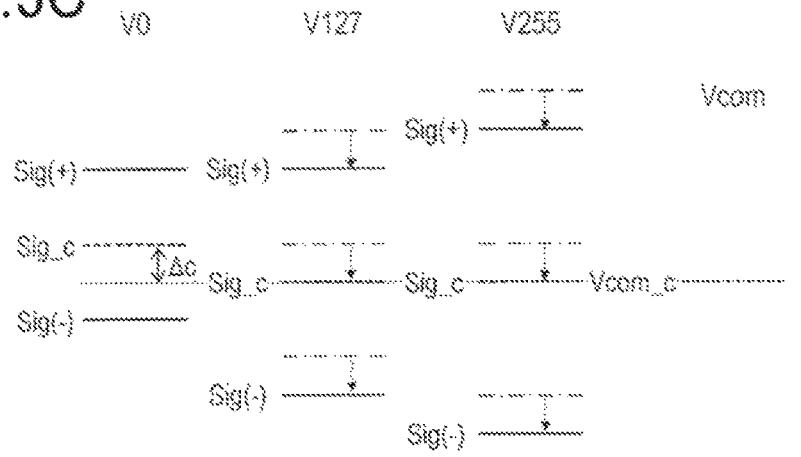
FIG. 5C is a diagram illustrating a method of setting source signal voltages and a common voltage in the liquid crystal display device 100.

Subsequently, as shown in FIG. 5C, the tentative source signal voltage is offset in the same direction as with the tentative common voltage for at least part of the gradation levels other than the lowest gradation level. In this example, the tentative source signal voltages are offset in the negative direction for all gradation levels other than the lowest gradation level and resultant source signal voltages are employed as final source signal voltages. After the offsetting is performed, the center levels Sig_c of the source signal voltages are lower than the center levels Sig_c' of the tentative source signal voltages for all gradation levels other than the lowest gradation level. Furthermore, for the lowest gradation level, the tentative source signal voltage of the lowest gradation level is directly employed as the final source signal voltage. That is, for the lowest gradation level, the center level Sig_c of the final source signal voltage is the same as the center level Sig_c' of the tentative source signal voltage. Note that in this example, after the offsetting is performed, the center levels Sig_c of the offset source signal voltages are the same for all gradation levels other than the lowest gradation level, and this equal level is the standard source center level after correction.

When the common voltage and the source signal voltages are set as described above with reference to FIG. 5A, FIG. 5B, and FIG. 5C, the result is that Δc at the lowest gradation level is greater than Δc at any other gradation levels, and the center level Sig_c of the source signal voltage at the lowest gradation level is apparently offset with respect to the center level Vcom_c of the common voltage and the corrected standard source center level. As a result, the amounts of charge accumulated in pixels which display the lowest gradation level become closer to the amounts of charge accumulated in pixels which display other gradation levels, which results in a reduction in the image retention. In addition, since it is not necessary to change the amplitude of the source signal voltage of the lowest gradation level, it is possible to prevent adverse effects on optical characteristics such as a reduction in the contrast ratio without having an increase in luminance in displaying black.

As described above, in the liquid crystal display device 100 according to the present embodiment, the common voltage and the source signal voltages at the gradation levels other than a gradation level to which an offset is to be given are offset in the same direction thereby providing a pseudo-offset to the gradation level to which the offset is to be given.

In a case where the common voltage and the source signal voltages are set as described with reference to FIG. 5A, FIG. 5B and FIG. 5C, a reduction occurs in the degree of symmetry of the source signal voltages of the gradation levels other than the gradation level (the lowest gradation level) to which the offset is given. Since source signal voltages of relatively low gradation levels are smaller in amplitude than source signal voltages of relatively high gradation levels, relatively large reductions occur in the degree of symmetry of gradation levels. Therefore, in the liquid crystal display device 100 according to the present embodiment, the degree of symmetry of gradation level voltage becomes equal to or smaller than 95% for at least one of gradation levels lower than 127/255-th gradation level. Typically, the degree of symmetry of gradation level voltage becomes equal to or smaller than 95% for as many gradation levels as one-third or greater the gradation levels lower than the 127/255-th gradation level. Note that the degree of symmetry of gradation level voltage may be equal to or smaller than 70% for some of gradation levels lower than the 127/255-th gradation level. Note that it is preferable that the degree of symmetry of gradation level voltage is 90% or higher at the lowest gradation level. When the degree of symmetry of gradation level voltage at the lowest gradation level is smaller than 90%, there is a possibility that an adverse effect may occur on the contrast ratio.

In the example described above, the process shown in FIG. 5C is performed after the process shown in FIG. 5B. However, the process shown in FIG. 5B may be performed after the process shown FIG. 5C, or the process shown in FIG. 5B and the process shown in FIG. 5C may be performed in parallel.

Furthermore, in the example described above with reference to FIG. 4 and other figures, the center levels Sig_c of the source signal voltages at gradation levels other than the lowest gradation level (that is, the corrected standard source center level) are equal to the center level Vcom_c of the common voltage. However, they may be different from each other. For example, to reduce an occurrence of flicker caused by a pull-in phenomenon, the center level Vcom_c of the common voltage may be offset with respect to the corrected standard source center level.

Furthermore, at least some of the gradation levels other than the lowest gradation level may be offset taking into account the pull-in phenomenon or the like (that is, the center level Sig_c may be different from the corrected standard source center level).

Although in the example described above, a pseudo-offset is given only to the lowest gradation level, a pseudo-offset may be given to some of other gradation levels in addition to the lowest gradation level.

[Results of Image Retention Evaluation and Verification of Effects on Optical Properties]

The liquid crystal display device 100 according to the present embodiment was made (Embodiment 1), and the results of evaluation of image retention and the verification of effects on optical characteristics are described together with results of evaluation and verification on liquid crystal display devices of Comparative Examples 1 and 2.

In Comparative Example 1, no offset (and neither a pseudo-offset) is given to the source signal voltage at the lowest gradation level. In Comparative Example 2, the source signal voltage at the lowest gradation level is offset by increasing the amplitude thereof such that the center level of the source signal voltage at the lowest gradation level is offset by −200 mV with respect to the standard source center level. The image retention was evaluated in 15 rankings by visual judgment through a ND (Neutral Density) filter as shown in Table 1. In the rankings shown in Table 1, the lower the value, the higher the degree of suppression of image retention.

TABLE 1

| ND JUDGMENT | RANK |
|---|---|
| NOT GOOD FOR 1% | 14 |
| 1% LEVEL | 13 |
| GOOD FOR 1% | 12 |
| 2% LEVEL | 11 |
| GOOD FOR 2% | 10 |
| 3% LEVEL | 9 |
| GOOD FOR 3% | 8 |
| 5% LEVEL | 7 |
| GOOD FOR 5% | 6 |
| 8% LEVEL | 5 |
| GOOD FOR 8% | 4 |
| 10% LEVEL | 3 |
| GOOD FOR 10% | 2 |
| NAKED-EYE LEVEL | 1 |
| GOOD FOR NAKED EYES | 0 |

Table 2 shows results of the image retention evaluation at room temperature for Comparative Example 1, Comparative Example 2, and the embodiment. Table 3 shows results of the image retention evaluation at 65° C. for Comparative Example 1 and the embodiment. Evaluation of image retention at room temperature was performed such that an image including an indication of a 0/255-th gradation level (a black level) and an indication of a 255/255 graduation level (a white level) was displayed for 24 hours at room temperature, and then a solid image of a 32/255 gradation level was displayed and a determination was made as to whether or not an afterimage of an image retention was observed through an ND filter. Evaluation of image retention at 65° C. was performed in a similar manner to the evaluation of the image retention at room temperature except that a black-and-white image was displayed for 8 hours at 65° C. In addition to the results of the image retention evaluation, Tables 2 and 3 also show amounts of offset [mV] of source signal voltages V0, V63, V127, V191, and V255 at some gradation levels (more specifically, 0/255-th, 63/255-th, 127/255-th, 191/255-th, and 255/255-th gradation levels), the center level (Vcom_c) [mV] of the common voltage, and the standard source center level [mV]. Note that the amount of offset is given by the center level of a source signal voltage of interest minus the standard source center level. Table 4 also shows Δc [mV] for the above-described gradation levels. Δc is given by the difference between the center level of the source signal voltage and the center level of the common voltage (the absolute value of the difference between the center level of the source signal voltage and the center level of the common voltage).

TABLE 2

| TEMPERATURE | | AMOUNT OF OFFSET [mV] V0 | V63 | V127 | V191 | V255 | Vcom_c [mV] | STANDARD SOURCE CENTER LEVEL [mV] | EVALUATION OF IMAGE RETENTION (AFTER 24 HOURS, SOLID IMAGE OF V32) |
|---|---|---|---|---|---|---|---|---|---|
| RT | COMPARATIVE EXAMPLE 1 | 0 | −17 | 0 | −30 | −50 | −23 | 0 | LEVEL OF ND 8% |
| | COMPARATIVE EXAMPLE 2 | −200 | −17 | 0 | −30 | −50 | −23 | 0 | LEVEL OF ND 10% |
| | EMBODIMENT 1 | −100 | −17 | 0 | −30 | −50 | 77 | 100 | GOOD FOR ND 10% |

TABLE 3

| TEMPERATURE | | AMOUNT OF OFFSET [mV] V0 | V63 | V127 | V191 | V255 | Vcom_c [mV] | STANDARD SOURCE CENTER LEVEL [mV] | EVALUATION OF IMAGE RETENTION (AFTER 8 HOURS, SOLID IMAGE OF V32) |
|---|---|---|---|---|---|---|---|---|---|
| 65° C. | COMPARATIVE EXAMPLE 1 | 0 | −17 | 0 | −30 | −50 | −23 | 0 | GOOD FOR ND 5% |
| | EMBODIMENT 1 | −100 | −17 | 0 | −30 | −50 | 77 | 100 | GOOD FOR ND 10% |

TABLE 4

| | ΔC [mV] | | | | | Vcom_c |
|---|---|---|---|---|---|---|
| | V0 | V63 | V127 | V191 | V255 | [mV] |
| COMPARATIVE EXAMPLE 1 | 23 | 6 | 23 | 7 | 27 | −23 |
| COMPARATIVE EXAMPLE 2 | 177 | 6 | 23 | 7 | 27 | −23 |
| EMBODIMENT 1 | 77 | 6 | 23 | 7 | 27 | 77 |

In Embodiment 1, as can be seen from Table 2 and Table 3, a greater improvement in the afterimage was achieved than in Comparative Example 1. Furthermore, as can be seen from Table 4, in Embodiment 1, unlike Comparative Example 1, Δc at the lowest gradation level is greater than Δc at any other gradation levels. In the example shown in Table 4, Δc at the lowest gradation level in Embodiment 1 is twice or greater than Δc at any other gradation levels.

As shown in Table 2, Comparative Example 2 provides a better improvement in the afterimage than Comparative Example 1. However, in Comparative Example 2, the amplitude of the source signal voltage V0 at the lowest gradation level is increased, and thus an adverse effect on optical characteristics occurs.

Figure 6A:
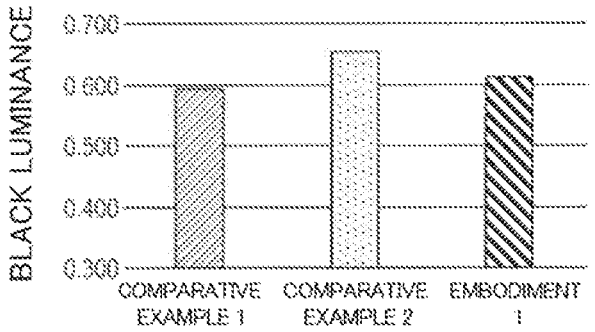
FIG. 6A is a graph representing a luminance in displaying black for Comparative Example 1, Comparative Example 2, and Embodiment 1.
Figure 6B:
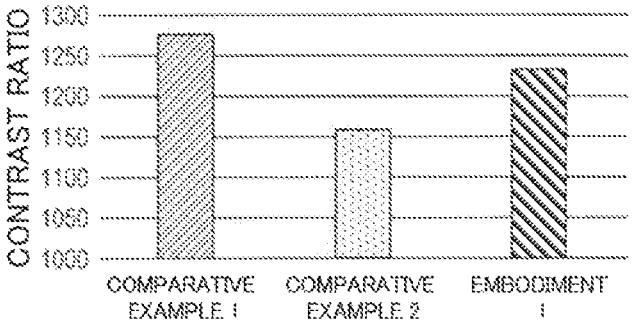
FIG. 6B is a graph representing a contrast ratio for Comparative Example 1, Comparative Example 2, and Embodiment 1.

FIG. 6A shows luminance obtained when black is displayed in Comparative Example 1, Comparative Example 2 and Embodiment 1. FIG. 6B illustrates contrast ratios in Comparative Example 1, Comparative Example 2, and Embodiment 1.

In Comparative Example 2, as shown in FIG. 6A and FIG. 6B, the black luminance in Comparative Example 2 is greater by about 7% than in Comparative Example 1, which results in a reduction in the contrast ratio by about 7%. In contrast, in Embodiment 1, almost no increase in black luminance occurs and almost no reduction in contrast ratio occurs compared with the Comparative Example 1.

As described above, in the liquid crystal display device 100 according to the present embodiment, it is possible to reduce image retention without having an adverse effect on the optical characteristics.

Table 5 shows examples of positive and negative polarity potentials of gradation level voltages (source signal voltages) and degrees of gradation level symmetry for Comparative Example 1, Comparative Example 2, and Embodiment 1. The gradation level voltages shown in Table 5 are different, in the strict sense, from the examples of gradation level voltages shown in Table 2 or elsewhere. Therefore, in Table 5, notations of "Comparative Example 1A", "Comparative Example 2A", and "Embodiment 1A" are used.

TABLE 5

| | COMPARATIVE EXAMPLE 1A | | | COMPARATIVE EXAMPLE 2A | |
|---|---|---|---|---|---|
| GRADATION LEVEL | POSITIVE POLARITY POTENTIAL | NEGATIVE POLARITY POTENTIAL | DEGREE OF SYMMETRY OF GRADATION LEVEL VOLTAGE | POSITIVE POLARITY POTENTIAL | NEGATIVE POLARITY POTENTIAL |
| 255/255 | 6.05 V | −6.15 V | 98.4% | 6.05 V | −6.15 V |
| 254/255 | 5.86 V | −5.95 V | 98.4% | 5.86 V | −5.95 V |
| 247/255 | 5.16 V | −5.25 V | 98.4% | 5.16 V | −5.25 V |
| 239/255 | 4.76 V | −4.84 V | 98.4% | 4.76 V | −4.84 V |
| 231/255 | 4.49 V | −4.56 V | 98.4% | 4.49 V | −4.56 V |
| 191/255 | 3.67 V | −3.73 V | 98.4% | 3.67 V | −3.73 V |
| 127/255 | 2.89 V | −2.94 V | 98.4% | 2.89 V | −2.94 V |
| 63/255 | 2.19 V | −2.22 V | 98.5% | 2.19 V | −2.22 V |
| 23/255 | 1.41 V | −1.43 V | 98.5% | 1.41 V | −1.43 V |
| 15/255 | 1.12 V | −1.13 V | 98.7% | 1.12 V | −1.13 V |
| 7/255 | 0.81 V | −0.82 V | 98.8% | 0.81 V | −0.82 V |
| 1/255 | 0.31 V | −0.31 V | 99.4% | 0.31 V | −0.31 V |
| 0/255 | 0.20 V | −0.20 V | 100.0% | 0.1 V | −0.4 V |

| | COMPARATIVE EXAMPLE 2A | EMBODIMENT 1A | | |
|---|---|---|---|---|
| GRADATION LEVEL | DEGREE OF SYMMETRY OF GRADATION LEVEL VOLTAGE | POSITIVE POLARITY POTENTIAL | NEGATIVE POLARITY POTENTIAL | DEGREE OF SYMMETRY OF GRADATION LEVEL VOLTAGE |
| 255/255 | 98.4% | 6.15 V | −6.05 V | 98.4% |
| 254/255 | 98.4% | 5.95 V | −5.86 V | 98.4% |
| 247/255 | 98.4% | 5.26 V | −5.15 V | 98.0% |
| 239/255 | 98.4% | 4.86 V | −4.74 V | 97.6% |
| 231/255 | 98.4% | 4.58 V | −4.47 V | 97.6% |
| 191/255 | 98.4% | 3.77 V | −3.63 V | 96.3% |
| 127/255 | 98.4% | 3.00 V | −2.85 V | 95.2% |
| 63/255 | 98.5% | 2.28 V | −2.13 V | 93.3% |
| 23/255 | 98.5% | 1.51 V | −1.33 V | 88.2% |
| 15/255 | 98.7% | 1.21 V | −1.04 V | 85.7% |
| 7/255 | 98.8% | 0.894 V | −0.71 V | 79.1% |
| 1/255 | 99.4% | 0.41 V | −0.21 V | 51.5% |
| 0/255 | 25.0% | 0.20 V | −0.20 V | 100.0% |

From Table 5, it can be seen that, in Comparative Example 1A and Comparative Example 2A, there are no gradation levels equal to or lower than the 127/255-th gradation level at which the degree of symmetry of gradation level voltage is equal or smaller than 95%. In contrast, in Embodiment 1A, the degree of symmetry of gradation level voltage is equal to or smaller than 95% at some gradation levels equal to or lower than the 127/255-th gradation level, and the degree of symmetry of gradation level voltage is even equal to or smaller than 70% at some gradation levels.

Embodiment 2

As described above, when the highest gradation level is displayed for a long time (especially in a high temperature environment), a degradation in display quality due to a residual charge may occur. The inventor of the present application has investigated a technique of offsetting a source signal voltage corresponding to a highest gradation level thereby reducing degradation of display quality due to a residual charge.

In a case where there is no restriction on the voltage input to the source driver IC (the driver IC), any offset can be provided without changing the source signal voltage at the highest gradation level (that is, while maintaining the same amplitude). However, in a case where there is a restriction on the voltage input to the source driver IC, (for example, in a case where the source signal voltage at the highest gradation level is defined by an upper limit and a lower limit of an allowed input range), to provide an offset, it is necessary to change the source signal voltage at the highest gradation level (that is, it is necessary to decrease the amplitude). As a result, a reduction occurs in luminance in displaying the highest gradation level, that is, in displaying white, and thus there is a possibility that an adverse effect on an optical characteristic such as a reduction in contrast ratio may occur. Regarding this, a further specific explanation is given below.

Figure 14:
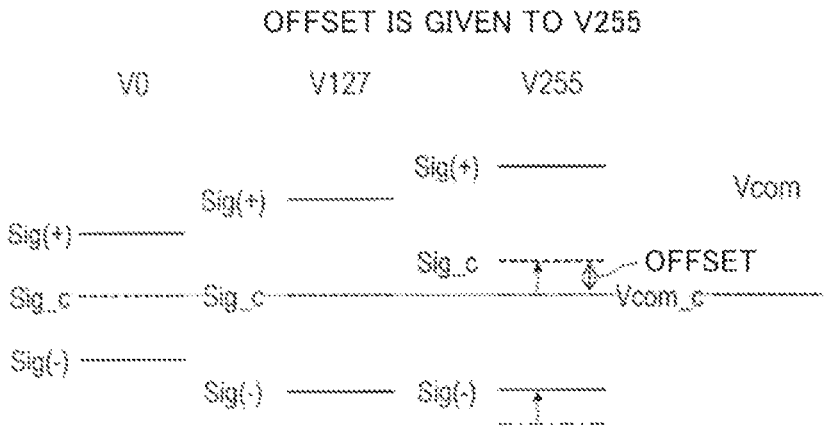
FIG. 14 is a diagram illustrating examples of source signal voltages and a common voltage for a case where offsetting is provided by reducing an amplitude of a source signal voltage V255 at a highest gradation level.

FIG. 14 shows an example of offsetting the source signal voltage V255 of the highest gradation level by changing the amplitude. In the example shown in FIG. 14, the offset is provided by reducing the amplitude of the source signal voltage V255 of the highest gradation level. In this example, the amplitude of the source signal voltage V255 of the highest gradation level is reduced while maintaining the positive polarity potential Sig(+). As a result, the negative polarity potential Sig(−) and the center level Sig_c are shifted to higher values. Therefore, the center level Sig_c of the source signal voltage V255 of the highest gradation level is different from the center level Vcom_c of the common voltage Vcom and the center level Sig_c of the source signal voltages of the other gradation levels (that is, the standard source center level). According to the example shown in FIG. 14, it is possible to reduce the degradation of the display quality caused by a residual charge. This is because the offsetting of the source signal voltage V255 at the highest gradation level causes optimum Vcom to be prevented from being shifted when displaying the highest gradation level is performed continuously. However, a reduction occurs in the amplitude of the source signal voltage V255 of the highest gradation level. This results in a reduction in the transmittance when white is displayed, and thus a reduction in contrast ratio occurs.

Furthermore, there is a possibility that the γ curve may deviate from the desired shape (deviate from the desired specifications). Inputting points (which are allowed to be arbitrarily set) of gradation level voltages are usually set every five gradation levels, and gradation level voltages other than those at the inputting points are determined by dividing, by resistance, the voltage difference between each adjacent inputting points. Therefore, in a case where an inputting point next to the highest gradation level is, for example, the 240/255 gradation level, changing of the gradation level voltage of the highest gradation level affects gradation level voltages of the 241/255-th gradation level to the 254/255-th gradation level, which may result in a shift of the γcurve from the desired shape.

In a case where an offset is provided by changing the amplitude of the source signal voltage of the highest gradation level, there is a possibility that an adverse effect on an optical characteristic may occur. In contrast, according to the present embodiment, the degradation of display quality caused by a residual charge can be reduced without adversely affecting the optical characteristics.

Figure 7:
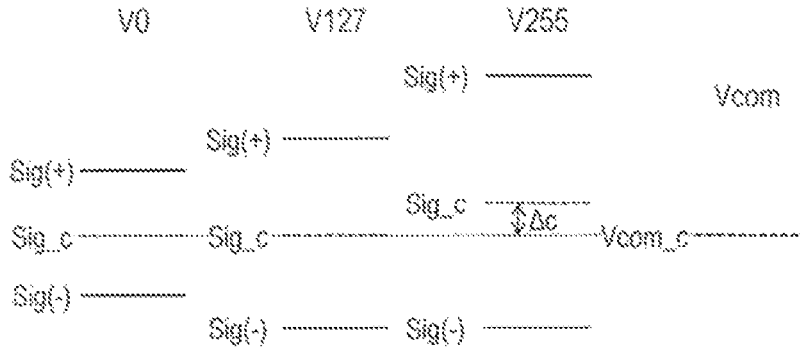
FIG. 7 is a diagram illustrating another example of setting of source signal voltages and a common voltage in a liquid crystal display device according to an embodiment of the present invention.

Referring to FIG. 7, the setting of the source signal voltages and common voltage in the liquid crystal display device according to the present embodiment is described.

FIG. 7 shows an example of setting source signal voltages and a common voltage according to the present embodiment.

In the example shown in FIG. 7, the source signal voltages include a source signal voltage V0 of the lowest gradation level (the 0/255-th gradation level), a source signal voltage V127 of the 127/255-th gradation level, and a source signal voltage V255 of the highest gradation level (the 255/255-th gradation level). For each source signal voltage, a positive polarity potential Sig(+), a negative polarity potential Sig (−), and a center level Sig_c are shown. For the common voltage, a center level Vcom_c is shown In the present embodiment, the common voltage and the source signal voltages corresponding to the respective gradation levels are set such that the source-common center difference at the highest gradation level is greater than the source-common center difference at least at part of the other gradation levels. More specifically, the common voltage and the source signal voltage corresponding to each gradation level are set such that Δc at the highest gradation level is greater than Δc at any other gradation levels. Although for simplicity of explanation, FIG. 7 illustrates a case where Δc is zero at gradation levels other than the highest gradation level, Δc may take a value other than zero at gradation levels other than the highest gradation level.

In the present embodiment, the degree of symmetry of gradation level voltage is equal to or lower than 95% at least at one of gradation levels equal to or lower than the 127/255-th gradation level except for the lowest gradation level (that is, at least one of gradation levels from the 1/255-th to 127/255-th gradation levels).

In the present embodiment, the common voltage and the source signal voltages in the liquid crystal display device may be set, for example, as follows.

Figure 8A:
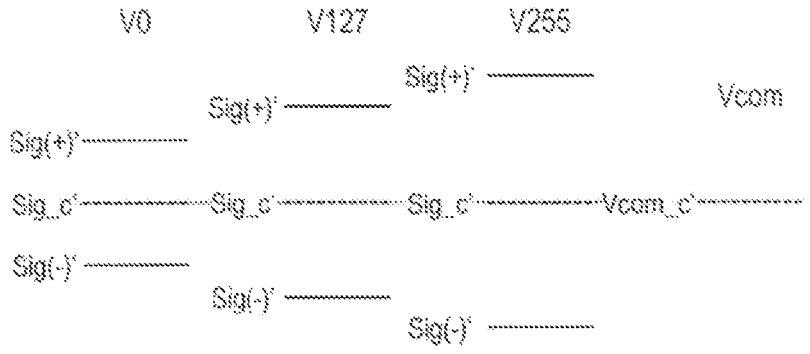
FIG. 8A is a diagram illustrating another method of setting source signal voltages and a common voltage in a liquid crystal display device according to an embodiment of the present invention.

First, as shown in FIG. 8A, a tentative common voltage and a tentative source signal voltage corresponding to each gradation level are set. In FIG. 8A, a positive polarity potential Sig(+)', a negative polarity potential Sig(−)', and a center level Sig_c' are shown for each of the tentative source signal voltages of the lowest gradation level (the 0/255-th gradation level), the 127/255-th gradation level, and the highest gradation level (the 255/255-th gradation level). Furthermore, a center level Vcom_c' is shown for the tentative common voltage. In this example, the center level Sig_c' is equal for all tentative source signal voltages at the respective gradation levels (an uncorrected standard source center level), and the center level Vcom_c' of the tentative common voltage is equal to this uncorrected standard source center level.

Figure 8B:
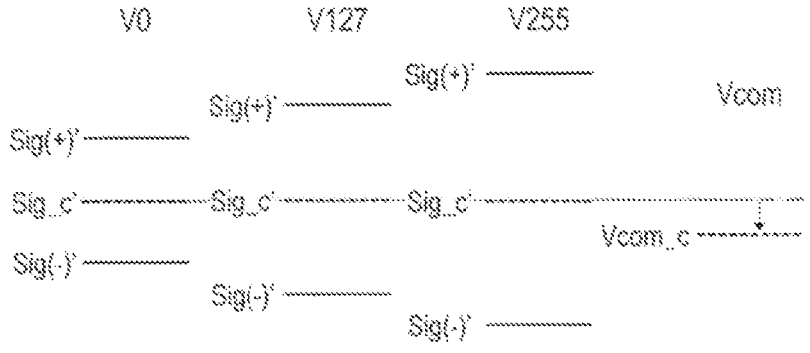
FIG. 8B is a diagram for illustrating another method of setting source signal voltages and a common voltage in a liquid crystal display device according to an embodiment of the present invention.

Next, the tentative common voltage is offset in one of the positive and negative directions, as shown in FIG. 8B. In this example, the tentative common voltage is offset in the negative direction, and a result is employed as a final common voltage. The center level Vcom_c of the common voltage after being offset is lower than the center level Vcom_c' of the tentative common voltage.

Figure 8C:
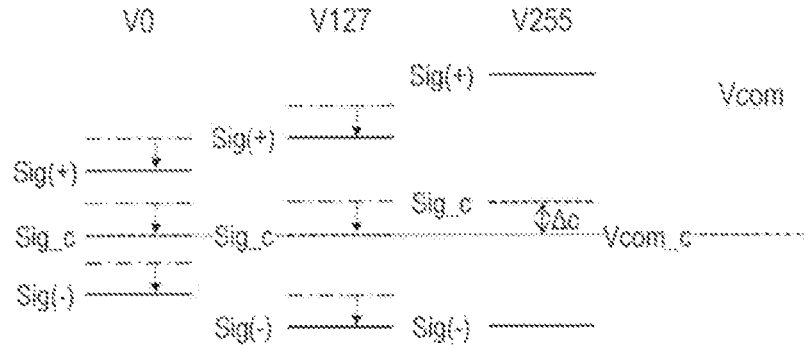
FIG. 8C is a diagram for illustrating another method of setting source signal voltages and a common voltage in a liquid crystal display device according to an embodiment of the present invention.

Subsequently, as shown in FIG. 8C, the tentative source signal voltage is offset in the same direction as with the tentative common voltage for at least part of the gradation levels other than the highest gradation level. In this example, the tentative source signal voltages are offset in the negative direction for all gradation levels other than the highest gradation level and resultant source signal voltages are employed as final source signal voltages. After the offsetting is performed, the center levels Sig_c of the source signal voltages are lower than the center levels Sig_c' of the tentative source signal voltages for all gradation levels other than the highest gradation level. Furthermore, for the highest gradation level, the tentative source signal voltage of the highest gradation level is directly employed as the final source signal voltage. That is, for the highest gradation level, the center level Sig_c of the final source signal voltage is the same as the center level Sig_c' of the tentative source signal voltage. Note that in this example, after the offsetting is performed, the center levels Sig_c of the offset source signal voltages are the same for all gradation levels other than the highest gradation level, and this equal level is the standard source center level after correction.

When the common voltage and the source signal voltages are set as described above with reference to FIG. 8A, FIG. 8B, and FIG. 8C, the result is that Δc at the highest gradation level is greater than Δc at any other gradation levels, and the center level Sig_c of the source signal voltage at the highest gradation level is apparently offset with respect to the center level Vcom_c of the common voltage and the corrected standard source center level. As a result, the degradation of display quality caused by a residual charge can be suppressed. In addition, since it is not necessary to change the amplitude of the source signal voltage at the highest gradation level, no reduction occurs in the transmittance in displaying white, and it is possible to prevent an adverse effect on optical characteristics such as a reduction in the contrast ratio.

Figure 9A:
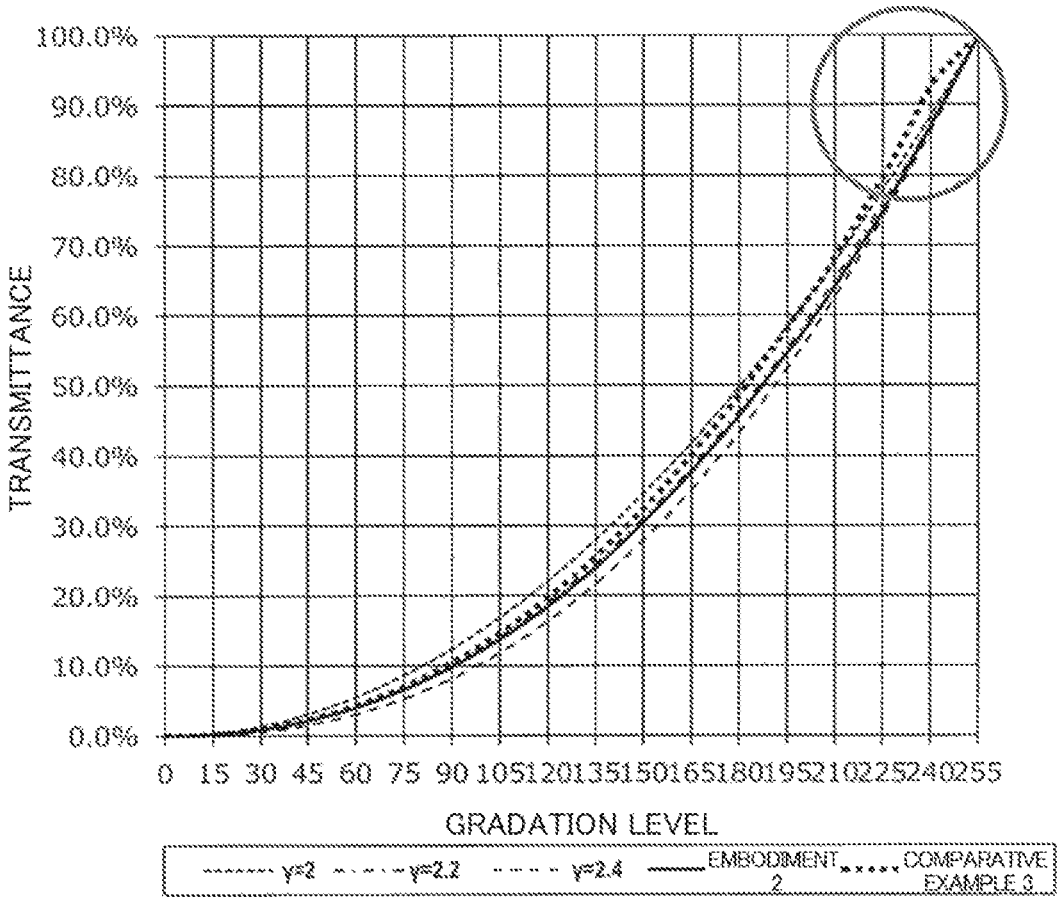
FIG. 9A is a graph representing γ curves (gradation level vs. transmittance characteristics) for Embodiment 2 and Comparative Example 3.
Figure 9B:
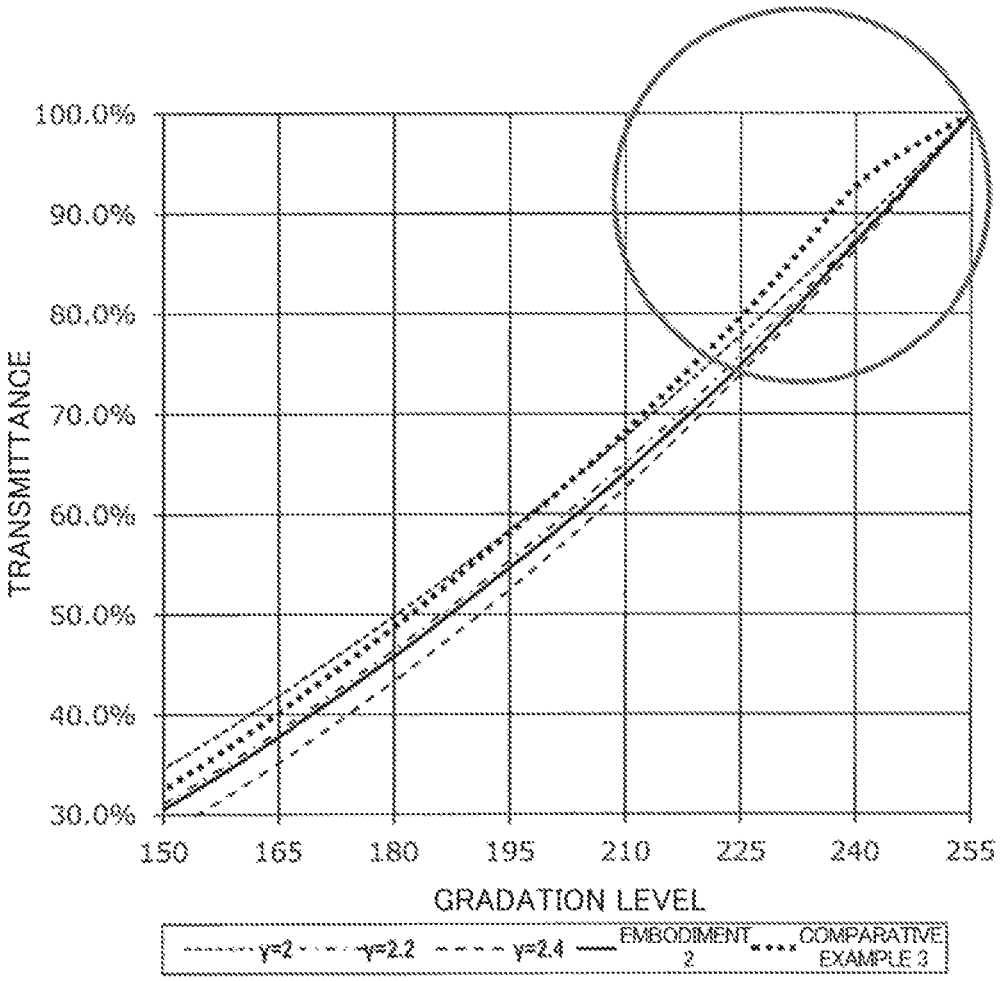
FIG. 9B is a graph representing 7 curves (gradation level vs. transmittance characteristics) for Embodiment 2 and Comparative Example 3 in which part of the graph shown in FIG. 9A is illustrated in an enlarged manner.

FIG. 9A and FIG. 9B show γ curves (gradation level vs. transmittance characteristics) for the liquid crystal display device according to the present embodiment (Embodiment 2) and for the liquid crystal display device of the Comparative Example 3 in which the source signal voltage of the highest gradation level is offset by the method described above with reference to FIG. 14. In addition, FIG. 9A and FIG. 9B also show γ curves for γ=2, γ=2.2, and γ=2.4. Note that FIG. 9B includes an enlarged illustration of a part of a range shown in FIG. 9A (more specifically, a range from the 150/255-th gradation level to the 255/255-th gradation level).

As shown in FIG. 9A and FIG. 9B, the γ curve in Embodiment 2 is maintained to be close to the specified desired curve (γ=2.2). In contrast, in Comparative Example 3, the γ carve deviates from the desired specification due to the effect of the change in the gradation level voltage at the highest gradation level (see in particular the area surrounded by a circle in the figure).

As described above, also in the liquid crystal display device according to the present embodiment, a pseudo-offset can be provided to a gradation level to which the offset is to be given by offsetting the common voltage and the source signal voltages at gradation levels other than the gradation level to which the offset is to be given in the same direction.

In a case where the common voltage and the source signal voltages are set as described with reference to FIG. 8A, FIG. 8B and FIG. 8C, the degree of symmetry of the gradation level voltage is equal to or smaller than 95% at least at one of gradation levels equal to or lower than the 127/255-th gradation level, for the same reason as that described in Embodiment 1. Typically, the degree of symmetry of gradation level voltage becomes equal to or smaller than 95% for as many gradation levels as one-third or greater the gradation levels lower than the 127/255-th gradation level. Note that the degree of symmetry of gradation level voltage may be equal to or smaller than 70% for some of gradation levels lower than the 127/255-th gradation level. Note that from the point of view of the optical characteristics (and more specifically, to prevent a reduction in luminance), it is preferable that the degree of symmetry of gradation level voltage at the highest gradation level is equal to or higher than 97%.

In the example described above, the process shown in FIG. 8C is performed after the process shown in FIG. 8B. However, the process shown in FIG. 8B may be performed after the process shown FIG. 8C, or the process shown in FIG. 8B and the process shown in FIG. 8C may be performed in parallel.

Furthermore, in the example described above with reference to FIG. 7 and other figures, the center levels Sig_c of the source signal voltages at gradation levels other than the highest gradation level (that is, the corrected standard source center level) are equal to the center level Vcom_c of the common voltage. However, they may be different from each other. For example, to reduce an occurrence of flicker caused by a pull-in phenomenon, the center level Vcom_c of the common voltage may be offset with respect to the corrected standard source center level.

Furthermore, at least some of the gradation levels other than the highest gradation level may be offset taking into account the pull-in phenomenon or the like (that is, the center level Sig_c may be different from the corrected standard source center level).

Although in the example described above, a pseudo-offset is given only to the highest gradation level, a pseudo-offset may be given to some of other gradation levels in addition to the highest gradation level.

Embodiment 3

Figure 10:
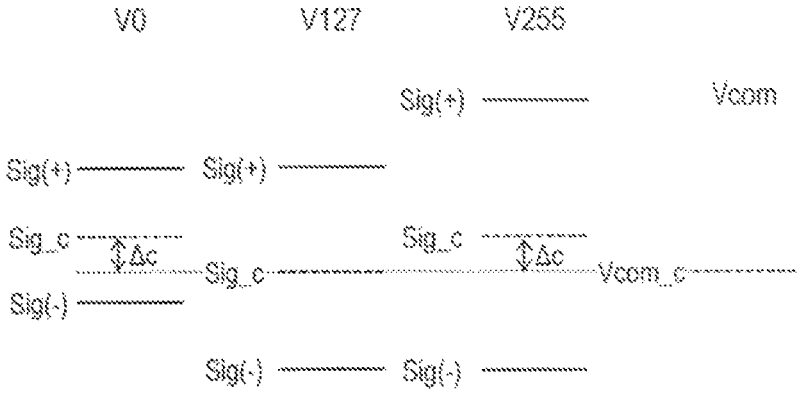
FIG. 10 is a diagram illustrating still another example of setting of source signal voltages and a common voltage in a liquid crystal display device according to an embodiment of the present invention.

With reference to FIG. 10, the setting of source signal voltages and a common voltage in the liquid crystal display device according to a third embodiment will be described.

FIG. 10 shows an example of setting source signal voltages and a common voltage according to the present embodiment. In the example shown in FIG. 10, the source signal voltages include a source signal voltage V0 of the lowest gradation level (the 0/255-th gradation level), a source signal voltage V127 of the 127/255-th gradation level, and a source signal voltage V255 of the highest gradation level (the 255/255-th gradation level). For each source signal voltage, a positive polarity potential Sig(+), a negative polarity potential Sig(−), and a center level Sig_c are shown. For the common voltage, a center level Vcom_c is shown In the present embodiment, the common voltage and the source signal voltage corresponding to each gradation levels are set such that the source-common center difference at the lowest gradation level and that at the highest gradation level are greater than the source-common center difference at least at part of the other gradation levels. More specifically, the common voltage and the source signal voltages corresponding to the respective gradation levels are set such that Δc at the lower gradation level and Δc at the highest gradation level are greater than Δc at any other gradation levels. Although for simplicity of explanation, FIG. 10 illustrates a case where Δc is zero at gradation levels other than the lowest and highest gradation levels, Δc may take a value other than zero at gradation levels other than the lowest and highest gradation levels.

Also on the present embodiment, the degree of symmetry of gradation level voltage is equal to or smaller than 95% at least at one of gradation levels equal to or lower than the 127/255-th gradation level.

In the present embodiment, the common voltage and the source signal voltages in the liquid crystal display device may be set, for example, as follows.

Figure 11A:
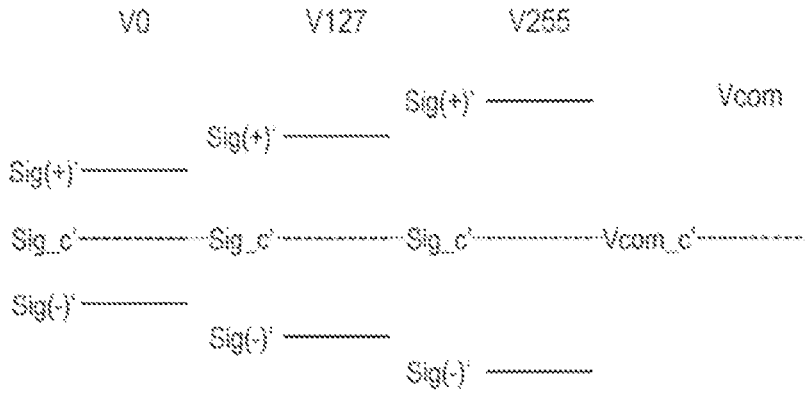
FIG. 11A is a diagram for illustrating still another method of setting source signal voltages and a common voltage in a liquid crystal display device according to an embodiment of the present invention.

First, as shown in FIG. 11A, a provisional common voltage and a provisional source signal voltage corresponding to each gradation is set. In FIG. 11A, a positive polarity potential Sig(+)', a negative polarity potential Sig(−)', and a center level Sig_c' are shown for each of the tentative source signal voltages of the lowest gradation level (the 0/255-th gradation level), the 127/255-th gradation level, and the highest gradation level (the 255/255-th gradation level). Furthermore, a center level Vcom_c' is shown for the tentative common voltage. In this example, the center level Sig_c' is equal for all tentative source signal voltages at the respective gradation levels (an uncorrected standard source center level), and the center level Vcom_c' of the tentative common voltage is equal to this uncorrected standard source center level.

Figure 11B:
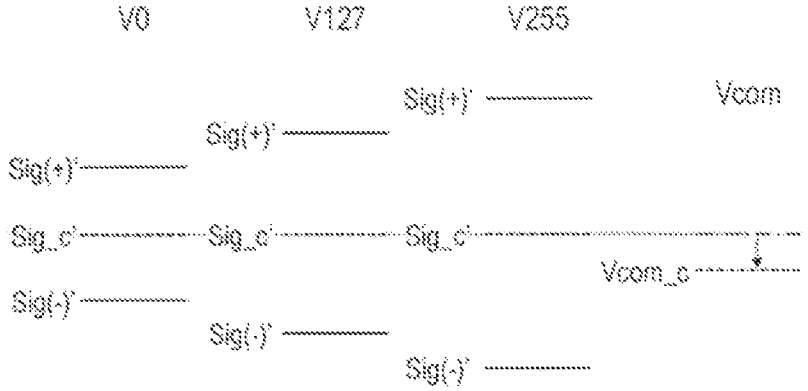
FIG. 11B is a diagram for illustrating still another method of setting source signal voltages and a common voltage in a liquid crystal display device according to an embodiment of the present invention.

Next, the tentative common voltage is offset in one of the positive and negative directions, as shown in FIG. 11B. In this example, the tentative common voltage is offset in the negative direction, and a result is employed as a final common voltage. The center level Vcom_c of the common voltage after being offset is lower than the center level Vcom_c' of the tentative common voltage.

Figure 11C:
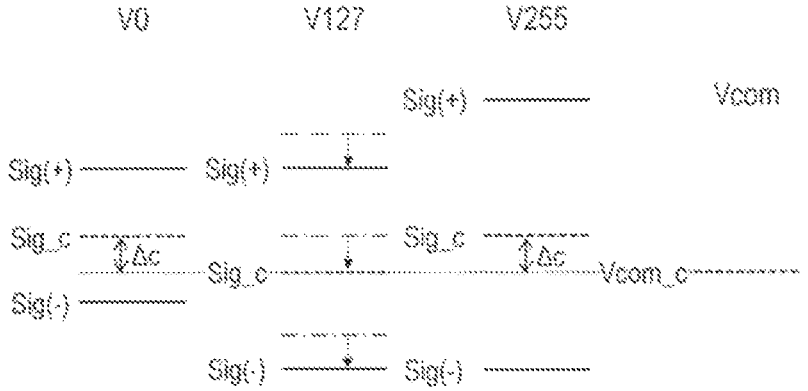
FIG. 11C is a diagram for illustrating still another method of setting source signal voltages and a common voltage in a liquid crystal display device according to an embodiment of the present invention.

Subsequently, as shown in FIG. 11C, the tentative source signal voltages are offset in the same direction as with the tentative common voltage for at least part of the gradation levels other than the lowest and highest gradation levels. In this example, the tentative source signal voltages are offset in the negative direction for all gradation levels other than the lowest and highest gradation levels and resultant source signal voltages are employed as final source signal voltages. After the offsetting is performed, the center levels Sig_c of the source signal voltages are lower than the center levels Sig_c' of the tentative source signal voltages for all gradation levels other than the lowest and highest gradation levels. Furthermore, for the lowest and highest gradation levels, the tentative source signal voltages are directly employed as the final source signal voltages. That is, for the lowest and highest gradation levels, the center levels Sig_c of the final source signal voltages are the same as the center levels Sig_c' of the tentative source signal voltages. Note that in this example, after the offsetting is performed, the center levels Sig_c of the offset source signal voltages are the same for all gradation levels other than the lowest and highest gradation levels, and this equal level is the standard source center level after correction.

When the common voltage and the source signal voltages are set as described above with reference to FIG. 11A, FIG. 11B, and FIG. 11C, the result is that Δc at the lowest gradation level and Δc at the highest gradation level are greater than Δc at any other gradation levels, and the center levels Sig_c of the source signal voltages at the lowest and highest gradation levels are apparently offset with respect to the center level Vcom_c of the common voltage and the corrected standard source center level. As a result, the occurrence of the image retention and the degradation of display quality caused by a residual charge can be suppressed. In addition, since it is not necessary to change the amplitudes of the source signal voltages of the lowest and highest gradation levels, no increase occurs in luminance in displaying black and no reduction occurs in transmittance in displaying white, and thus it is possible to prevent adverse effects on optical characteristics.

As described above, also in the liquid crystal display device according to the present embodiment, a pseudo-offset can be provided to a gradation level to which the offset is to be given by offsetting the common voltage and the source signal voltages at gradation levels other than the gradation level to which the offset is to be given in the same direction.

In a case where the common voltage and the source signal voltages are set as described with reference to FIG. 11A, FIG. 11B and FIG. 11C, the degree of symmetry of the gradation level voltage is equal to or smaller than 95% at least at one of gradation levels equal to or lower than the 127/255-th gradation level, for the same reason as that described in Embodiment 1. Typically, the degree of symmetry of gradation level voltage becomes equal to or smaller than 95% for as many gradation levels as one-third or greater the gradation levels lower than the 127/255-th gradation level. Note that the degree of symmetry of gradation level voltage may be equal to or smaller than 70% for some of gradation levels lower than the 127/255-th gradation level. Note that it is preferable that the degree of symmetry of gradation level voltage is 90% or higher at the lowest gradation level. When the degree of symmetry of gradation level voltage at the lowest gradation level is smaller than 90%, there is a possibility that an adverse effect may occur on the contrast ratio. Note that from the point of view of the optical characteristics (and more specifically, to prevent a reduction in luminance), it is preferable that the degree of symmetry of gradation level voltage at the highest gradation level is equal to or higher than 97%.

Table 6 shows examples of positive and negative polarity potentials of gradation level voltages (source signal voltages) and degrees of gradation level symmetry in the liquid crystal display device according to the present embodiment (Embodiment 3).

TABLE 6

| | EMBODIMENT 3 | | |
|---|---|---|---|
| GRADATION LEVEL | POSITIVE POLARITY POTENTIAL | NEGATIVE POLARITY POTENTIAL | DEGREE OF SYMMETRY OF GRADATION LEVEL VOLTAGE |
| 255/255 | 6.05 V | −6.15 V | 101.7% |
| 254/255 | 5.95 V | −5.86 V | 98.4% |
| 247/255 | 5.26 V | −5.15 V | 98.0% |
| 239/255 | 4.86 V | −4.74 V | 97.6% |
| 231/255 | 4.58 V | −4.47 V | 97.6% |
| 191/255 | 3.77 V | −3.63 V | 96.3% |
| 127/255 | 3.00 V | −2.85 V | 95.2% |
| 63/255 | 2.28 V | −2.13 V | 93.3% |
| 23/255 | 1.51 V | −1.33 V | 88.2% |

TABLE 6-continued

| GRADATION LEVEL | EMBODIMENT 3 POSITIVE POLARITY POTENTIAL | NEGATIVE POLARITY POTENTIAL | DEGREE OF SYMMETRY OF GRADATION LEVEL VOLTAGE |
|---|---|---|---|
| 15/255 | 1.21 V | −1.04 V | 85.7% |
| 7/255 | 0.894 V | −0.71 V | 79.1% |
| 1/255 | 0.41 V | −0.21 V | 51.5% |
| 0/255 | 0.22 V | −0.20 V | 90.9% |

In Embodiment 3, as can be seen from Table 6, the degree of symmetry of gradation level voltage is equal to or smaller than 95% at some gradation levels equal to or lower than the 127/255-th gradation level, and the degree of symmetry of gradation level voltage is even equal to or smaller than 70% at some gradation levels. In Embodiment 3, the degree of symmetry of the gradation level voltage at the lowest gradation level is equal to or higher than 90% and the degree of symmetry of the gradation level voltage at the highest gradation level is equal to or higher than 97%.

In the example described above, the process shown in FIG. 11C is performed after the process shown in FIG. 11B. However, the process shown in FIG. 11B may be performed after the process shown FIG. 11C, or the process shown in FIG. 11B and the process shown in FIG. 11C may be performed in parallel.

Furthermore, in the example described above with reference to FIG. 10 and other figures, the center levels Sig_c of the source signal voltages at gradation levels other than the lowest and highest gradation levels (that is, the corrected standard source center level) are equal to the center level Vcom_c of the common voltage. However, they may be different from each other. For example, to reduce an occurrence of flicker caused by a pull-in phenomenon, the center level Vcom_c of the common voltage may be offset with respect to the corrected standard source center level.

Furthermore, at least part of the gradation levels other than the lowest and highest gradation levels may be offset taking into account the pull-in phenomenon or the like (that is, the center level Sig_c may be different from the corrected standard source center level).

Although in the example described above, a pseudo-offset is given only to the lowest and highest gradation levels, a pseudo-offset may be given to some of other gradation levels in addition to the lowest and highest gradation level gradation level.

(Method of Manufacturing Liquid Crystal Display Device)

The voltage setting methods described above with reference to Embodiments 1, 2 and 3 are suitable for use in a method of producing a liquid crystal display device including a process of setting a common voltage and a source signal voltage corresponding to each gradation level by the voltage setting method described above. Other than the process of setting the common voltage and the source signal voltages, various processes of producing a liquid crystal display device using the in-plane electric field mode (for example, the FFS mode, the IPS mode, or the like) according to known methods may be used.

Embodiments of the present invention are widely applicable to liquid crystal display devices using in-plane electric field mode.

The invention claimed is:

1. A liquid crystal display device comprising: a liquid crystal display panel including a plurality of pixels, the liquid crystal display panel including an active matrix substrate, a counter substrate opposing the active matrix substrate, and a liquid crystal layer disposed between the active matrix substrate and the counter substrate; and a control circuit configured to generate source signal voltages supplied to respective pixels of the plurality of pixels in response to receiving input display signals indicating gradation levels to be displayed by the respective pixels of the plurality of pixels, the active matrix substrate including pixel electrodes which are provided in the respective pixels of the plurality of pixels and to which the source signal voltages are applied, and a common electrode to which a common voltage is applied to generate, together with the pixel electrodes, in-plane electric fields, wherein when a source-common center difference is defined by a difference between a center level of each source signal voltage and a center level of the common voltage, the common voltage and the source signal voltage corresponding to each gradation level are set such that the source-common center difference at least at one of a lowest gradation level and a highest gradation level is greater than the source-common center difference at least at part of the other gradation levels, and wherein when Vp denotes an absolute value of a positive polarity potential of each source signal voltage and Vn denotes an absolute value of a negative polarity potential of each source signal voltage, and a degree of symmetry of a gradation level voltage at each gradation level is defined such that when a relationship Vp>Vn is satisfied for Vp and Vn of the source signal voltage at a 127/255-th gradation level, the degree of symmetry is given by (Vn/Vp)−100[%] while when a relationship Vp<Vn is satisfied for Vp and Vn of the source signal voltage at the 127/255-th gradation level, the degree of symmetry is given by (Vp/Vn)−100[%], the degree of symmetry of the gradation level voltage is equal to or smaller than 95% at least at one of gradation levels equal to or lower than the 127/255-th gradation level.

2. The liquid crystal display device according to claim 1, wherein the source-common center difference at least at one of the lowest and highest gradation levels is two or more times as great as the source-common center difference at the other one of the lowest and highest gradation levels.

3. The liquid crystal display device according to claim 1, wherein the common voltage and the source signal voltage corresponding to each gradation level are set such that the source-common center difference at the lowest gradation level is greater than the source-common center difference at least at part of the other gradation levels.

4. The liquid crystal display device according to claim 3, wherein the degree of symmetry of the gradation level voltage at the lowest gradation level is equal to or greater than 90%.

5. The liquid crystal display device according to claim 1, wherein the common voltage and the source signal voltage corresponding to each gradation level are set such that the source-common center difference at the highest gradation level is greater than the source-common center difference at least at part of the other gradation levels.

6. The liquid crystal display device according to claim 5, wherein the degree of symmetry of the gradation level voltage at the highest gradation level is equal to or greater than 97%.

7. The liquid crystal display device according to claim 1, wherein the common voltage and the source signal voltage corresponding to each gradation level are set such that the source-common center difference at the lowest gradation level and the source-common center difference at the highest gradation level are greater than the source-common center difference at least at part of the other gradation levels.

8. The liquid crystal display device according to claim 7, wherein the degree of symmetry of the gradation level voltage at the lowest gradation level is equal to or higher than 90% and the degree of symmetry of the gradation level voltage at the highest gradation level is equal to or higher than 97%.

9. The liquid crystal display device according to claim 1, wherein the common voltage and the source signal voltage corresponding to each gradation level are set such that the source-common center difference at least at one of the lowest gradation level and the highest gradation level is greater than the source-common center difference at any one of the other gradation levels.

10. The liquid crystal display device according to claim 1, wherein the common voltage and source signal voltage corresponding to each gradation level are set such that the source-common center difference at the lowest gradation level is greater than the source-common center difference at any one of the other gradation levels.

11. The liquid crystal display device according to claim 1, wherein the common voltage and source signal voltage corresponding to each gradation level are set such that the source-common center difference at the highest gradation level is greater than the source-common center difference at any one of other gradation levels.

12. The liquid crystal display device according to claim 1, wherein the common voltage and the source signal voltages corresponding to each gradation level are set such that the source-common center differences at the lowest gradation level and the highest gradation level are greater than the source-common center difference at any one of the other gradation levels.

13. A voltage setting method for setting the common voltage and the source signal voltage corresponding to each gradation level of the liquid crystal display device according to claim 1, the method comprising (A) setting a tentative common voltage and a tentative source signal voltage corresponding to each gradation level, (B) offsetting the tentative common voltage in one direction of the positive and negative directions, and (C) offsetting the tentative source signal voltage in the one direction at least at part of the gradation levels except for at least one of the lowest and highest gradation levels.

14. The voltage setting method according to claim 13, wherein, in (C), the tentative source signal voltages are offset for all gradation levels other than the lowest gradation level.

15. The voltage setting method according to claim 13, wherein, in (C), the tentative source signal voltages are offset for all gradation levels other than the highest gradation level.

16. The voltage setting method according to claim 13, wherein, in (C), the tentative source signal voltages are offset for all gradation levels other than the lowest and highest gradation levels.

17. A method of producing a liquid crystal display device, comprising setting the common voltage and the source signal voltage corresponding to each gradation level by using the voltage setting method according to claim 13.

* * * * *